US006432225B1

(12) United States Patent
Schriever

(10) Patent No.: US 6,432,225 B1
(45) Date of Patent: Aug. 13, 2002

(54) NON-CHROMATED OXIDE COATING FOR ALUMINUM SUBSTRATES

(75) Inventor: Matthias P. Schriever, Kent, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 09/687,807

(22) Filed: Oct. 13, 2000

Related U.S. Application Data

(60) Provisional application No. 60/163,103, filed on Nov. 2, 1999.

(51) Int. Cl.[7] ..... C23C 22/48

(52) U.S. Cl. ..... 148/273; 148/274; 148/275; 148/286; 106/14.11; 106/14.15; 252/389.53

(58) Field of Search ..... 148/273, 274, 148/275, 285, 286; 106/14.11, 14.15; 428/469; 252/389.53

(56) References Cited

U.S. PATENT DOCUMENTS

| | | | |
|---|---|---|---|
| 1,551,613 | A | 9/1925 | Pacz |
| 1,607,676 | A | 11/1926 | Jirotka |
| 2,796,370 | A | 6/1957 | Ostrander et al. |
| 2,796,371 | A | 6/1957 | Ostrander et al. |
| 2,906,009 | A | 9/1959 | Knoll et al. |
| 3,138,479 | A | 6/1964 | Foley |
| 3,403,035 | A | 9/1968 | Schneble et al. |
| 3,423,214 | A | 1/1969 | Koretzky |
| 3,438,798 | A | 4/1969 | Baudrand et al. |
| 3,444,007 | A | 5/1969 | Maurer et al. |
| 3,592,747 | A | 7/1971 | Cohn |
| 3,615,740 | A | 10/1971 | Goltz |
| 3,790,453 | A | 2/1974 | Wanamaker et al. |
| 3,819,424 | A | 6/1974 | Russell et al. |

FOREIGN PATENT DOCUMENTS

| | | |
|---|---|---|
| AU | A 39376/89 | 8/1990 |
| DE | 745704 | 11/1944 |
| EP | 0356756 A1 | 7/1990 |
| GB | 953987 | 4/1964 |
| GB | 1345868 | 2/1974 |
| JP | 61-238979 | 11/1986 |
| WO | WO 91/11542 | 8/1991 |
| WO | WO 96/29448 | 9/1996 |

OTHER PUBLICATIONS

W. Fernelius et al., *Inorganic Syntheses,* vol. II, pp. 216–225 (McGraw–Hill 1946) (No month data available).

A. Brenner et al., "Deposition of Nickel and Cobalt by Chemical Reduction", *J. of Research of the National Bureau of Standards,* pp. 385–395, vol. 39, Nov. 1947.

*Primary Examiner*—John Sheehan
*Assistant Examiner*—Andrew L. Oltmans
(74) *Attorney, Agent, or Firm*—Paul C. Cullom, Jr.

(57) ABSTRACT

An improved process that is commercially practical for forming an oxide film cobalt conversion coating exhibiting corrosion resistance and paint adhesion properties on a substrate, where the substrate is aluminum or aluminum alloy, the process including the steps of: (a) providing an oxide film forming cobalt conversion solution comprising an aqueous reaction solution, containing no triethanolamine (TEA), prepared by reacting the following starting materials: (1) a water soluble cobalt-II salt $CoX_2$ where X=Cl, Br, $NO_3$, CN, SCN, $\frac{1}{3}PO_4$, $\frac{1}{2}SO_4$, $\frac{1}{2}CO_3$, formate, or acetate; (2) a water soluble complexing agent selected from the group consisting of $MeNO_2$, MeAc, MeFm, $NH_4Ac$, and $NH_4Fm$ where Me is Na, K, or Li; Ac is acetate; and Fm is formate; (3) an accelerator selected from the group consisting of $NaClO_3$, $NaBrO_3$, and $NaIO_3$; (4) water; and (b) contacting the substrate with the aqueous reaction solution for a sufficient amount of time to oxidize the surface of the substrate, whereby the oxide film cobalt conversion coating is formed, thereby imparting corrosion resistance and paint adhesion properties to the substrate.

(List continued on next page.)

13 Claims, 7 Drawing Sheets

U.S. PATENT DOCUMENTS

| | | | | |
|---|---|---|---|---|
| 3,870,607 | A | | 3/1975 | Bardach |
| 3,877,981 | A | | 4/1975 | Arnold |
| 3,905,838 | A | | 9/1975 | Ito |
| 3,928,237 | A | | 12/1975 | Davis |
| 3,954,510 | A | | 5/1976 | Gunn et al. |
| 3,993,510 | A | | 11/1976 | Bellavin |
| 4,088,486 | A | | 5/1978 | Bissonette |
| 4,150,172 | A | | 4/1979 | Kolk, Jr. |
| 4,208,212 | A | | 6/1980 | Kuzuwata et al. |
| 4,218,240 | A | | 8/1980 | Gingerich et al. |
| 4,233,063 | A | | 11/1980 | Ritsko et al. |
| 4,261,766 | A | | 4/1981 | Crouch |
| 4,278,263 | A | | 7/1981 | Vanderpool et al. |
| 4,278,477 | A | | 7/1981 | Reinhold |
| 4,337,097 | A | | 6/1982 | Tokumasu et al. |
| 4,348,224 | A | | 9/1982 | Gingerich et al. |
| 4,381,203 | A | | 4/1983 | Reinhold |
| 4,392,920 | A | | 7/1983 | McDonald |
| 4,631,093 | A | | 12/1986 | Etemovich |
| 4,637,374 | A | | 1/1987 | Arai |
| 4,647,347 | A | | 3/1987 | Schoener |
| 4,659,605 | A | | 4/1987 | Malik et al. |
| 4,696,724 | A | | 9/1987 | Deguchi et al. |
| 4,717,431 | A | * | 1/1988 | Knaster et al. ..... 428/628 |
| 4,804,407 | A | | 2/1989 | Scheithauer et al. |
| 4,897,129 | A | | 1/1990 | Tuttle, Jr. et al. |
| 5,298,092 | A | | 3/1994 | Schriever |
| 5,378,293 | A | | 1/1995 | Schriever |
| 5,411,606 | A | | 5/1995 | Schriever |
| 5,415,687 | A | | 5/1995 | Schriever |
| 5,468,307 | A | | 11/1995 | Schriever |
| 5,472,524 | A | | 12/1995 | Schriever |
| 5,487,949 | A | | 1/1996 | Schriever |
| 5,551,994 | A | | 9/1996 | Schriever |
| 5,873,953 | A | | 2/1999 | Schriever |

OTHER PUBLICATIONS

A. Martell et al., *Chemistry Of The Metal Chelate Compounds,* pp. 1–18 (Prentice–Hall 1952) (No month data available).

P. Pascal, *Nouveau Traite de Chimie Minerale,* 1959, Masson & Cie, Paris, Fr., vol. XVIII, pp. 680–681: COBALT-NITRITES (with English translation) (No month data available).

S. Wein, "Nickel and Cobalt Films", *The Glass Industry,* pp. 22, 23, 35, and 46, Jan. 1960.

I. Tsu et al., "Regulating Coercivity of Magnetic Thin Films" *IBM Tech. Discl. Bull.,* pp. 52–53, vol. 4, No. 8, Jan. 1962.

G. Jander et al., *Einfuhrung in das anorganisch—chemische Praktikum* (1968), pp. 106–107 (No month data available).

M. Munakata, "Some New Oxygenated Cobalt Complexes", *Bulletin of the Chemical Society of Japan,* vol. 44, pp. 1791–1796 (1971) (No month data available).

*Van Nostand's Scientific Encyclopedia* (1983), 6th ed., vol. 1, p. 124, "Ammines" (No month data available).

S. Fukuzumi et al., "Activation of Cobalt (III)–Alkyl Bonds Through Interaction With Organic Oxidants and the Catalytic Effect of $Mg^{2+}$Ion on Alkyl Transfer Reactions from cis–Dialkylcobalt (III) Complexes to p–Benzoquinone Derivatives", *Chemistry Letters,* pp. 421–424 (1984).

I. Sasaki et al., "X–Ray and Electrochemical Investigation of a Series of Cobalt Complexes with Tetra– and Quinquedentate Schiff Base Ligands and their Catalytic Properties in the Oxidation of 2,6–Ditertbutylphenol by Molecular Oxygen", *Polyhedron,* vol. 6, No. 12, pp. 2103–2110 (1987).

Kirk–Othmer, "Cobalt Compounds", *Encyclopedia of Chemical Technology, 4th* ed., vol. 6, p. 778 (1993) (No month data available).

* cited by examiner

NON-CHROMATED OXIDE COATING FOR ALUMINUM SUBSTRATES

CROSS-REFERENCE TO RELATED APPLICATION

This application claims the benefit of provisional application No. 60/163,103 filed Nov. 2, 1999 entitled NON-CHROMATED OXIDE COATING FOR ALUMINUM SUBSTRATES.

FIELD OF THE INVENTION

This environmental-quality invention is in the field of chemical conversion coatings formed on aluminum and aluminum alloy substrates. One aspect of the invention is an improved process of forming an oxide coating, referred to as a "cobalt conversion coating," that is chemically formed by oxidizing the surface of an aluminum or aluminum alloy substrate. The invention enhances the quality of the environment of mankind by contributing to the maintenance of air and water quality. The term "aluminum" as used herein includes aluminum and aluminum alloys.

BACKGROUND ART

Reference is made to the following patents, which are incorporated by reference herein: U.S. Pat. No. 5,298,092, issued Mar. 29, 1994; U.S. Pat. No. 5,415,687, issued May 16, 1995; U.S. Pat. No. 5,472,524, issued Dec. 5, 1995; U.S. Pat. No. 5,487,949, issued Jan. 30, 1996; U.S. Pat. No. 5,378,293, issued Jan. 3, 1995; U.S. Pat. No. 5,411,606, issued May 2, 1995; U.S. Pat. No. 5,551,994, issued Sep. 3, 1996; and U.S. Pat. No. 5,873,953, issued Feb. 23, 1999.

Recently, I have made significant improvements to this technology to further improve bath life and bath stability as well as coating performance characteristics. The details are described below.

Environmental regulations in the United States are mandating drastic reductions of allowed chromium compounds in effluent as well as emissions into the air which are generated from metal finishing processes. I have devoted considerable effort to the development of a non-chromated surface coating as a replacement for current chromated processes as detailed in MIL-C-5514 and Boeing Process Specification BAC 5719.

Chromium containing conversion coatings are used by The Boeing Company, its subcontractor base and generally throughout the industry. Solutions used to produce these conversion coatings contain carcinogenic hexavalent chromium, fluorides, and cyanides, all of which present a significant environmental, health, and safety problem. The constituents of a typical chromate conversion-coating bath are as follows: $CrO_3$ "chromic acid" (hexavalent); NaF sodium fluoride; $KF_4B$ potassium tetrafluoborate; $K_2ZrF_6$ potassium hexafluorozirconate; $K_3Fe(CN)_6$ potassium ferricyanide; and $HNO_3$ nitric acid.

Current chromium conversion films are deposited by immersion, meet a 168-hour corrosion resistance requirement when tested to ASTM B117, but also serve as a surface substrate to promote paint adhesion. Typical coating weights of these chromium films range from 40 to 120 mg/ft$^2$ and do not cause a fatigue life reduction of the aluminum substrate.

SUMMARY OF THE INVENTION

In one aspect the invention is an improved process that is commercially practical for forming an oxide film cobalt conversion coating exhibiting corrosion resistance and paint adhesion properties on a substrate, where the substrate is aluminum or aluminum alloy, the process including the steps of:

(a) providing an oxide film forming cobalt conversion solution comprising an aqueous reaction solution, containing no triethanolamine (TEA), prepared by reacting the following starting materials:
  (1) a water soluble cobalt-II salt $CoX_2$ where X=Cl, Br, $NO_3$, CN, SCN, $\frac{1}{3}PO_4$, $\frac{1}{2}SO_4$, $\frac{1}{2}CO_3$, formate, or acetate;
  (2) a water soluble complexing agent selected from the group consisting of $MeNO_2$, MeAc, MeFm, $NH_4Ac$, and $NH_4Fm$ where Me is Na, K, or Li; Ac is acetate; and Fm is formate;
  (3) an accelerator selected from the group consisting of $NaClO_3$, $NaBrO_3$, and $NaIO_3$;
  (4) water; and (b) contacting the substrate with the aqueous reaction solution for a sufficient amount of time to oxidize the surface of the substrate, whereby the oxide film cobalt conversion coating is formed, thereby imparting corrosion resistance and paint adhesion properties to the substrate.

In another aspect the invention is a chemical conversion coating solution that is commercially practical for producing an oxide film cobalt conversion coating on an aluminum or aluminum alloy substrate, said solution comprising an aqueous reaction solution, containing no triethanolamine (TEA), prepared by reacting the following starting materials:

(1) a water soluble cobalt-II salt $CoX_2$ where X=Cl, Br, $NO_3$, CN, SCN, $\frac{1}{3}PO_4$, $\frac{1}{2}SO_4$, $\frac{1}{2}CO_3$, formate, or acetate;

(2) a water soluble complexing agent selected from the group consisting of $MeNO_2$, MeAc, MeFm, $NH_4Ac$, and NH4Fm, where Me is Na, K, or Li; Ac is acetate; and Fm is formate;

(3) an accelerator selected from the group consisting of $NaClO_3$, $NaBrO_3$, and $NaIO_3$;

(4) water.

In yet another aspect the invention is an improved process that is commercially practical for forming an oxide film cobalt conversion coating exhibiting corrosion resistance and paint adhesion properties on a substrate, where the substrate is aluminum or aluminum alloy, the process comprising the steps of:

(a) providing an oxide film forming cobalt conversion solution comprising an aqueous reaction solution, containing no triethanolamine (TEA), prepared by reacting the following starting materials:
  (1) a water soluble cobalt-II salt $CoX_2$ where X=Cl, Br, $NO_3$, CN, SCN, $\frac{1}{3}PO_4$, $\frac{1}{2}SO_4$, $\frac{1}{2}CO_3$, formate, or acetate;
  (2) an ammonium salt $NH_4X$ where X=Cl, Br, $NO_3$, CN, SCN, $\frac{1}{3}PO_4$, $\frac{1}{2}SO_4$, $\frac{1}{3}CO_3$, formate, or acetate;
  (3) ammonium hydroxide (ammonia);
  (4) an accelerator selected from the group consisting of $NaClO_3$, $NaBrO_3$, and $NaIO_3$;
  (5) water; and (b) contacting the substrate with the aqueous reaction solution for a sufficient amount of time to oxidize the surface of the substrate, whereby the oxide film cobalt conversion coating is formed, thereby imparting corrosion resistance and paint adhesion properties to the substrate.

And in yet another aspect the invention is a chemical conversion coating solution that is commercially practical for producing an oxide film cobalt conversion coating on an aluminum or aluminum alloy substrate, the solution comprising an aqueous reaction solution, containing no triethanolamine (TEA), prepared by reacting the following starting materials:

(1) a water soluble cobalt-II salt $CoX_2$ where X=Cl, Br, $NO_3$, CN, SCN, $\frac{1}{3}PO_4$, $\frac{1}{2}SO_4$, $\frac{1}{2}CO_3$, formate, or acetate;

(2) an ammonium salt $NH_4X$ where X=Cl, Br, $NO_3$, CN, SCN, $\frac{1}{3}PO_4$, $\frac{1}{2}SO_4$, $\frac{1}{2}CO_3$, formate, or acetate;

(3) ammonium hydroxide (ammonia);

(4) an accelerator selected from the group consisting of $NaClO_3$, $NaBrO_3$, and $NaIO_3$; and (5) water.

BRIEF DESCRIPTION OF THE DRAWINGS

The figures are photomicrographs produced by a scanning electron microscope of improved cobalt conversion coatings made by the present invention on aluminum alloy test panels. For example.

FIG. 1 is a photomicrograph at 1,000× magnification of a test panel showing an unsealed cobalt conversion coating of the invention. The photomicrograph is a top view of the upper surface of the oxide coating. This test panel was immersed in a cobalt conversion coating solution of the present invention at a temperature of 140° F. for 30 minutes. (The preferred bath temperature for longer bath life and bath stability is 120° F.) The white bar is a length of 10 μm (10 micrometers).

DESCRIPTION OF THE PREFERRED EMBODIMENTS

Figure 1:
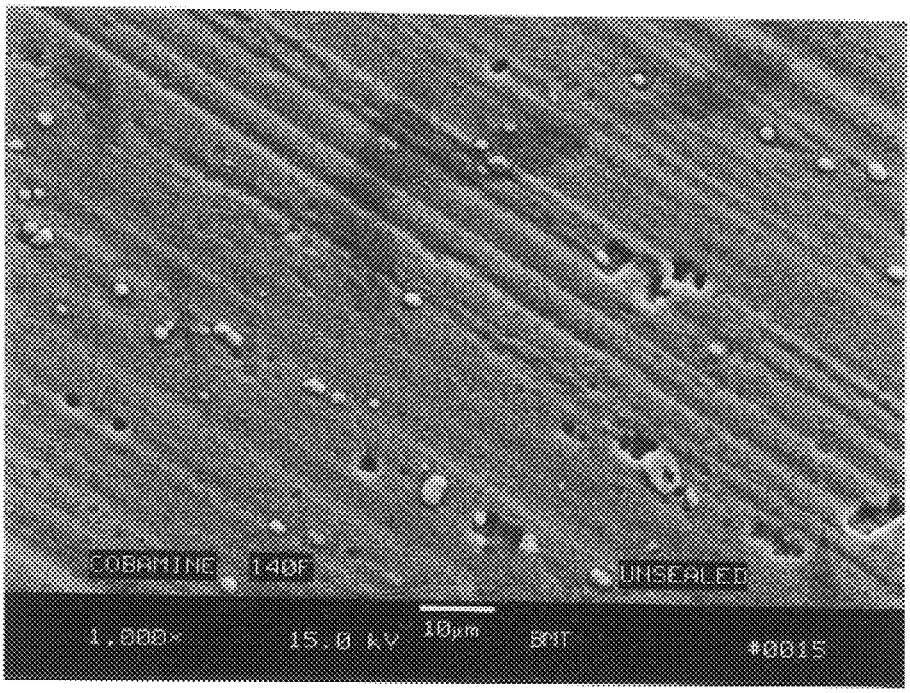
FIG. 1 is a photomicrograph (where the scanning electron microscope operated at 15 kV) of an aluminum alloy 2024-T3 test panel having cobalt conversion coating made by the present invention without being sealed (without being given a post conversion treatment in a solution containing vanadium pentoxide and sodium tungstate (described below in Example 4)). The cobalt conversion coatings formed by the present improved process are cobalt oxides and aluminum oxide mixed structures formed by oxidizing the surface of the aluminum alloy substrate.
Figure 2:
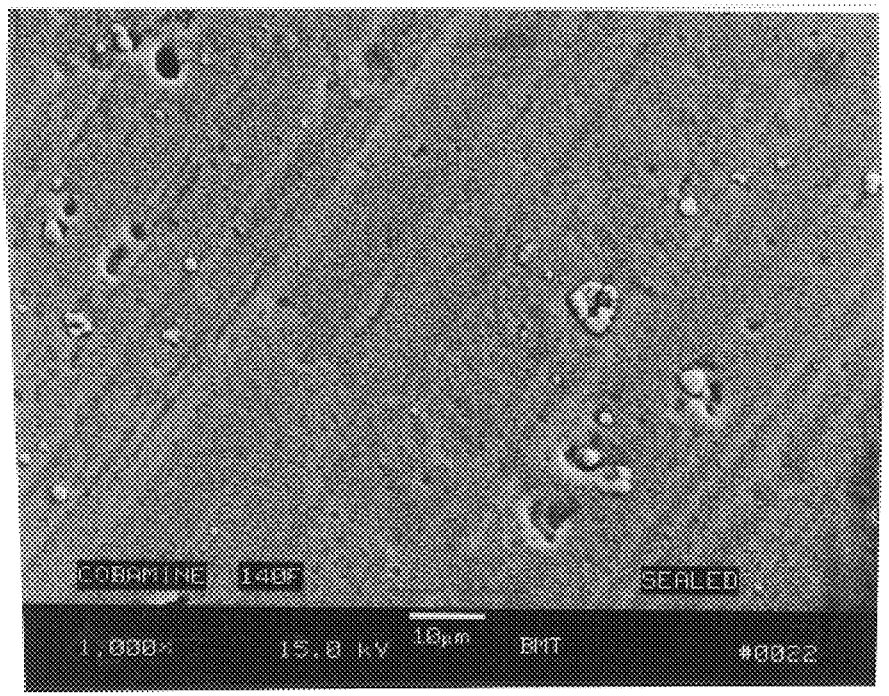
FIG. 2 is a photomicrograph at 1,000× magnification of a test panel showing a sealed cobalt conversion coating of the invention. The cobalt conversion coating was sealed by being given a post treatment in a solution containing vanadium pentoxide and sodium tungstate (described below in Example 4). The photomicrograph is a top view of the upper surface of the sealed oxide coating. The white bar is a length of 10 μm (10 micrometers).
Figure 3:
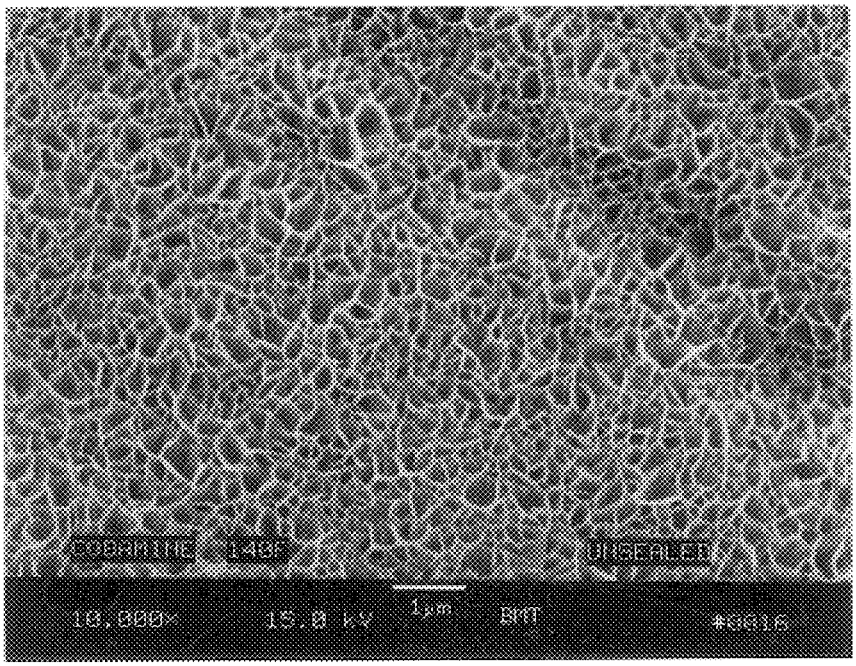
FIG. 3 is a photomicrograph at 10,000× magnification of a test panel showing an unsealed cobalt conversion coating of the invention. The photomicrograph is a top view of the upper surface of the unsealed oxide coating. The white bar is a length of 1 μm (1 micrometer).
Figure 4:
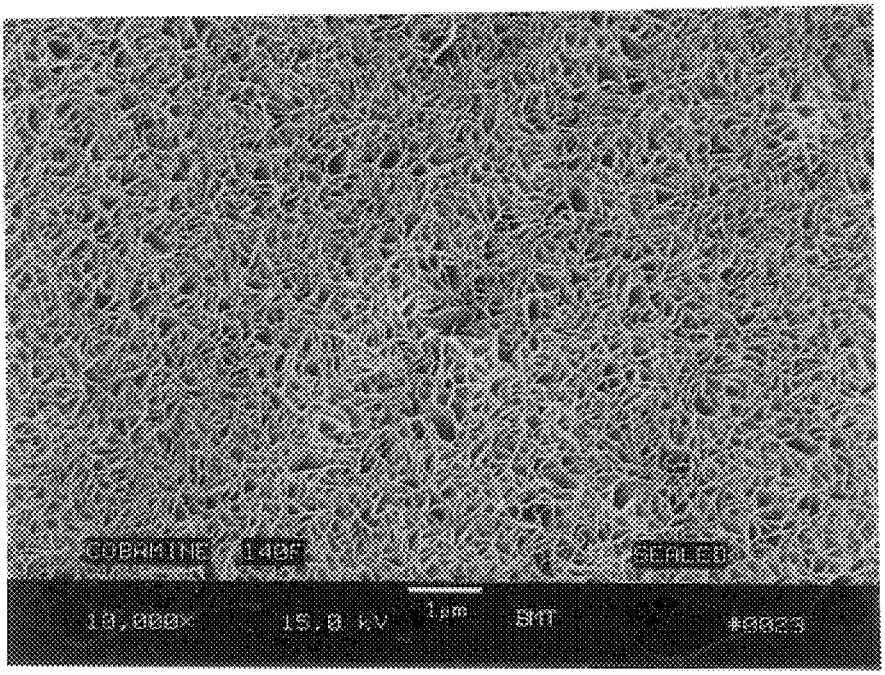
FIG. 4 is a photomicrograph at 10,000× magnification of a test panel showing a sealed cobalt conversion coating of the invention. The cobalt conversion coating was sealed by being given a post treatment in a solution containing vanadium pentoxide and sodium tungstate (described below in Example 4). The photomicrograph is a top view of the upper surface of the sealed oxide coating. The white bar is a length of 1 μgm (1 micrometer).
Figure 5:
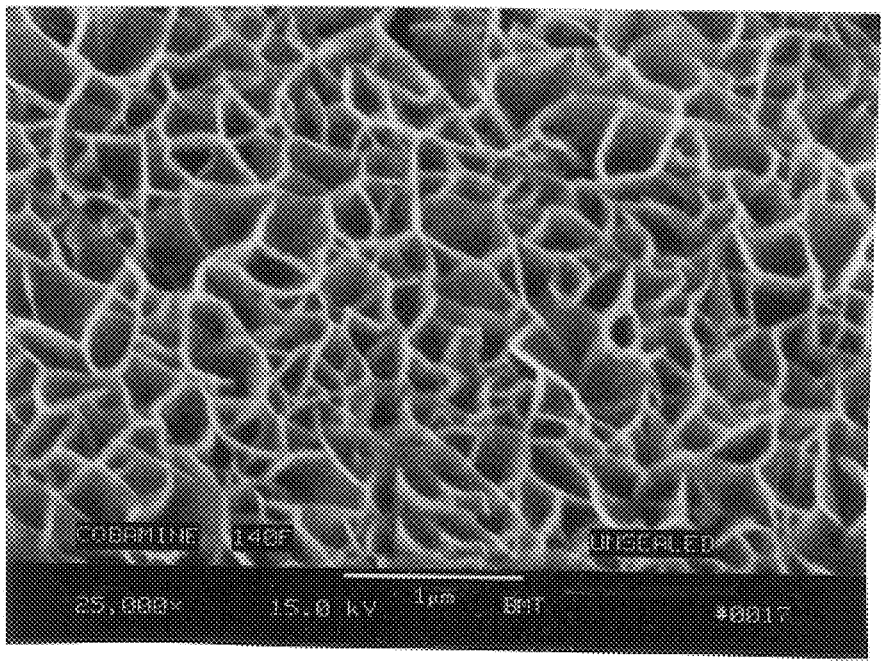
FIG. 5 is a photomicrograph at 25,000× magnification of a test panel showing an unsealed cobalt conversion coating of the invention. The photomicrograph is a top view of the upper surface of the unsealed oxide coating. The white bar is a length of 1 μm (1 micrometer).
Figure 6:
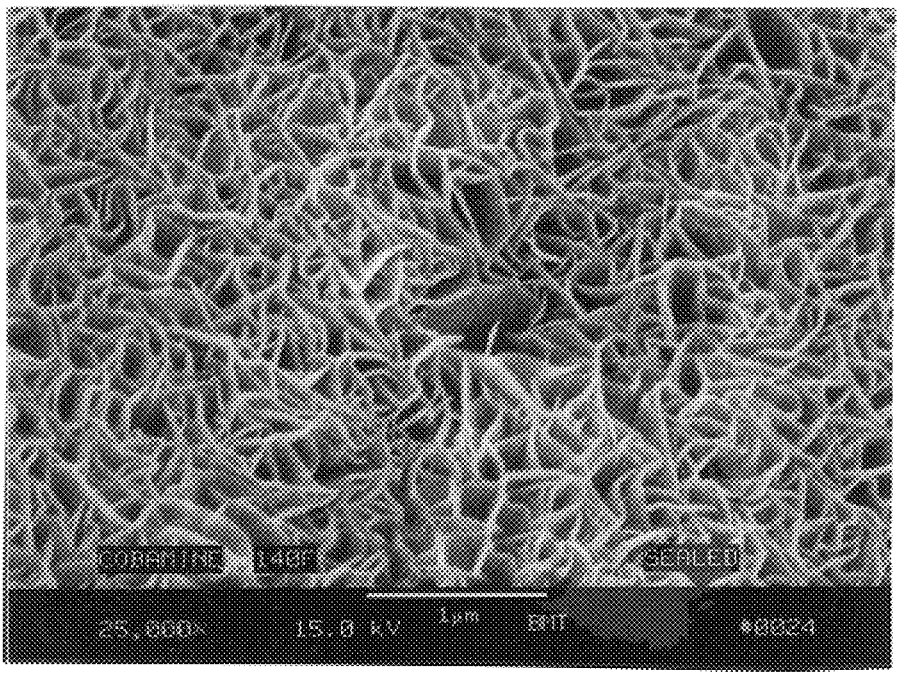
FIG. 6 is a photomicrograph at 25,000× magnification of a test panel showing a sealed cobalt conversion coating of the invention. The cobalt conversion coating was sealed by being given a post treatment in a solution containing vanadium pentoxide and sodium tungstate (described below in Example 4). The photomicrograph is a top view of the upper surface of the sealed oxide coating. The white bar is a length of 1 μm (1 micrometer).
Figure 7:
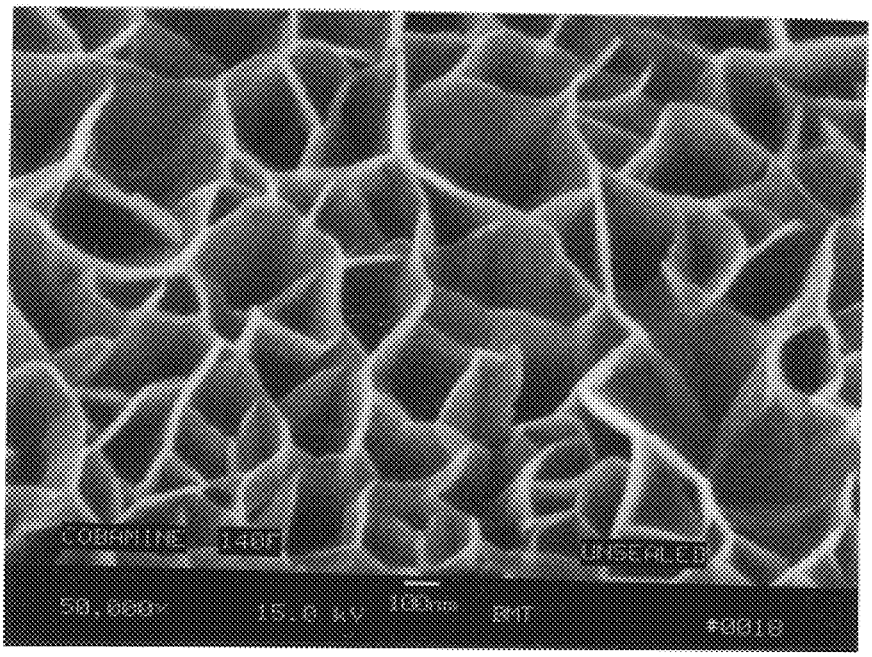
FIG. 7 is a photomicrograph at 50,000× magnification of a test panel showing an unsealed cobalt conversion coating of the invention. The photomicrograph is a top view of the upper surface of the unsealed oxide coating. The white bar is a length of 100 nm (100 nanometers).
Figure 8:
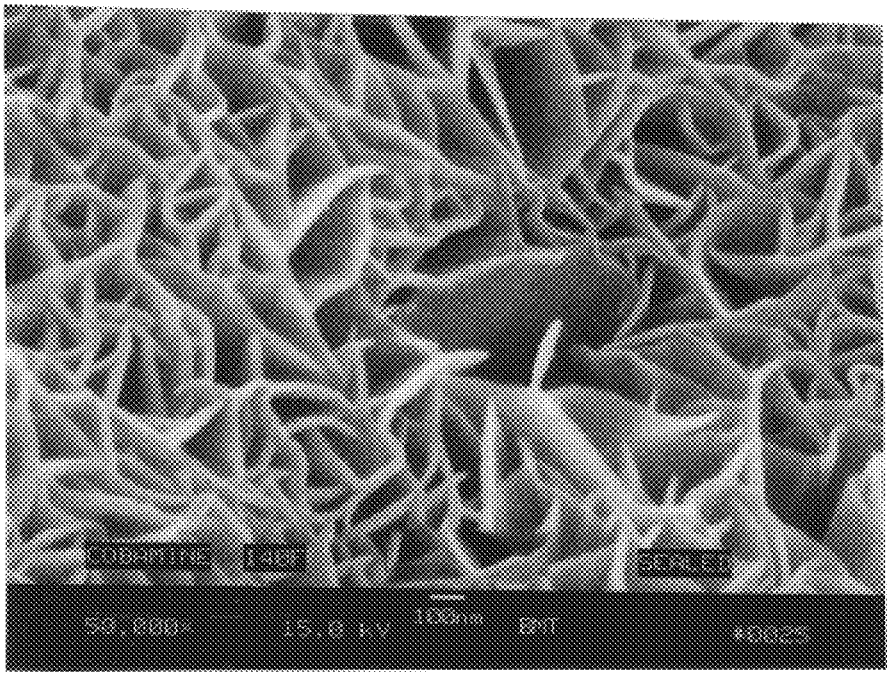
FIG. 8 is a photomicrograph at 50,000× magnification of a test panel showing a sealed cobalt conversion coating of the invention. The cobalt conversion coating was sealed by being given a post treatment in a solution containing vanadium pentoxide and sodium tungstate (described below in Example 4). The photomicrograph is a top view of the upper surface of the sealed oxide coating. The white bar is a length of 100 nm (100 nanometers).
Figure 9:
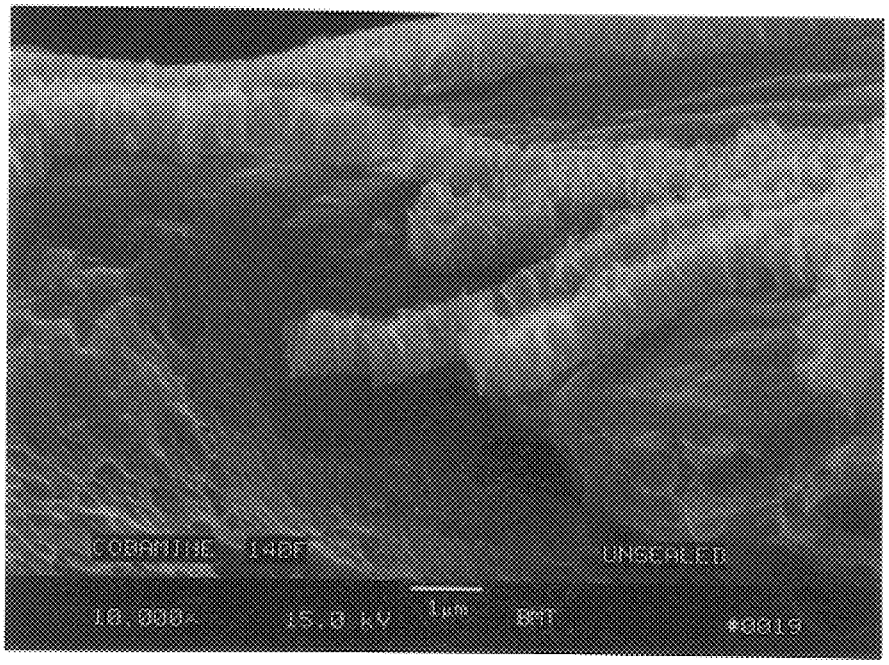
FIG. 9 is a photomicrograph at 10,000× magnification of a test panel showing a side view of a fractured cross section of an unsealed cobalt conversion coating of the invention. To make the photomicrographs of FIGS. 9–14, the test panels were bent and broken off to expose a cross section of the oxide coating. The white bar is a length of 1 μm (1 micrometer).
Figure 10:
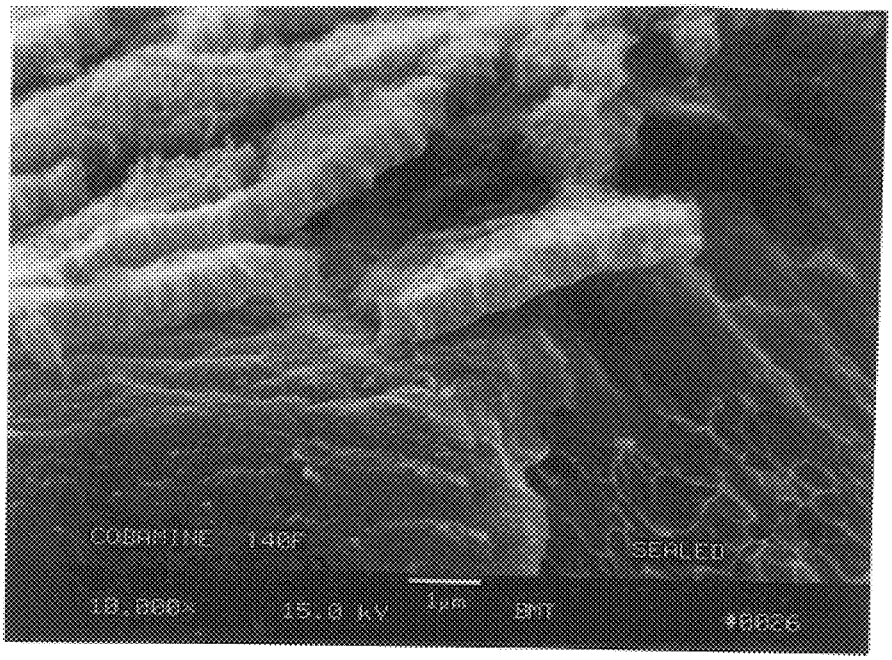
FIG. 10 is a photomicrograph at 10,000× magnification of a test panel showing a side view of a fractured cross section of a sealed cobalt conversion coating of the invention. The white bar is a length of 1 μm (1 micrometer).
Figure 11:
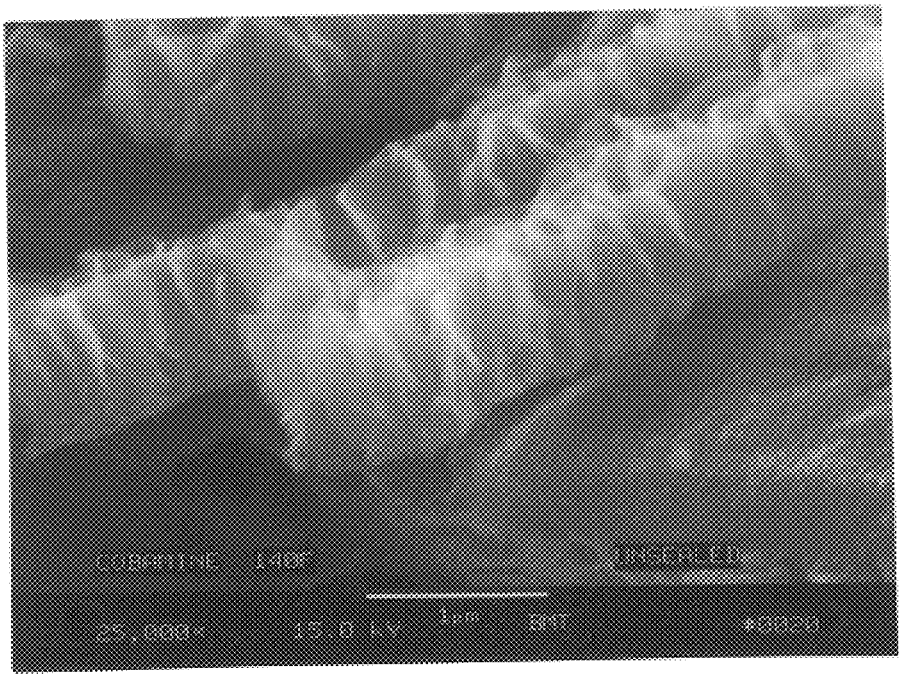
FIG. 11 is a photomicrograph at 25,000× magnification of a test panel showing a side view of a fractured cross section of an unsealed cobalt conversion coating of the invention. The white bar is a length of 1 μm (1 micrometer).
Figure 12:
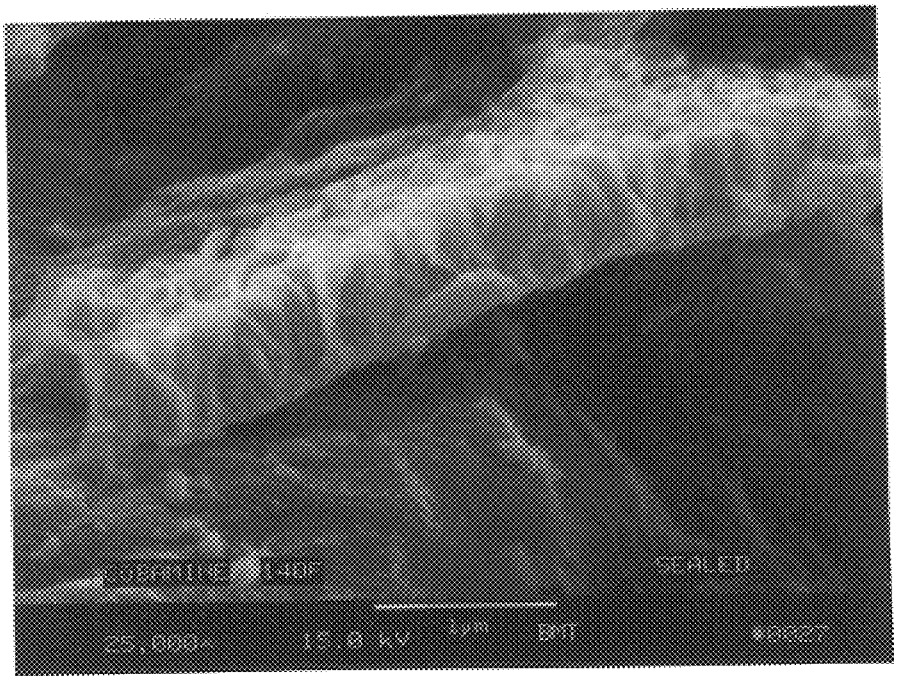
FIG. 12 is a photomicrograph at 25,000× magnification of a test panel showing a side view of a fractured cross section of a sealed cobalt conversion coating of the invention. The white bar is a length of 1 μm (1 micrometer).
Figure 13:
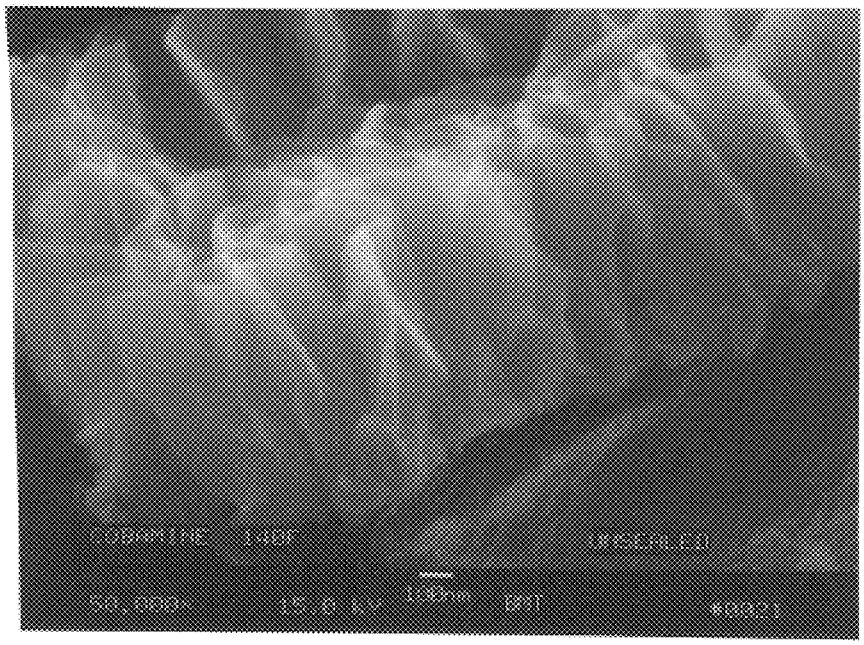
FIG. 13 is a photomicrograph at 50,000× magnification of a test panel showing a side view of a fractured cross section of an unsealed cobalt conversion coating of the invention. The white bar is a length of 100 nm (100 nanometers).
Figure 14:
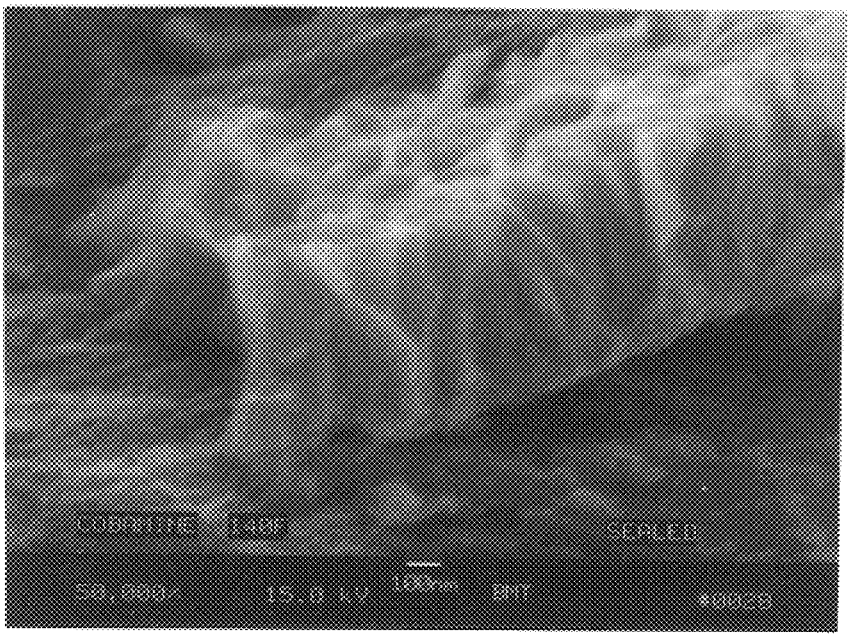
FIG. 14 is a photomicrograph at 50,000× magnification of a test panel showing a side view of a fractured cross section of a sealed cobalt conversion coating of the invention. The white bar is a length of 100 nm (100 nanometers).

Earlier work described in the above listed patents dealt with the formation of cobalt complexes and the addition of other chemical agents intended to accelerate the reaction of these cobalt complexes on the aluminum substrate, thus forming the desired conversion coatings (without these accelerators no coating is formed). While these formulations all produced usable coatings, they did not deliver the desired consistency in corrosion resistance needed for daily production. Furthermore, practical bath lives were still found to be marginal. With ammoniated cobalt complexes, it was always the excess of ammonium hydroxide (ammonia) which functioned as the bath accelerator. In the case of nitrite complexes, iodides, such as NaI, or triethanolamine were used as accelerators, and with acetate/formate complexes, either fluorides or the ammonium ion were the accelerators. A universal and much more effective bath accelerator has now been discovered and has been successfully used with all prior cobalt complexing solutions. This most preferred bath accelerator is sodium chlorate, $NaClO_3$. Sodium chlorate is effective when used in conjunction with positive cobalt ligand complexes and it was found to be especially effective when used in conjunction with negative cobalt ligand complexes, i.e.:

$Me_3$ $[Co(NO_2)_6]$ where $NO_2$=nitrite and Me=Na, K, Li, or $Me_3$ $[Co(Ac)_6]$ where Ac=acetate, or $Me_3$ $[Co(Fm)_6]$ where Fm=formate.

Use of sodium chlorate, $NaClO_3$, as bath accelerator has resulted in the following significant process improvements:

1. Practical bath life in excess of 6 months (now usable for commercial production).
2. Added bath stability and performance consistency.
3. Consistent salt spray corrosion resistance performance.
4. Bath control simplification, i.e., daily pH analysis no longer required.
5. The post conversion treatment using the $V_2O_5/Na_2WO_4$ solution is effective at room temperature and no longer requires heating when the accelerator is added.

The sodium chlorate accelerator was successfully used with all prior disclosed cobalt complexes utilized for conversion coating formation. However, the cobalt nitrite complexing chemistry described in U.S. Pat. No. 5,472,524, which is incorporated by reference herein, is suitable for production because of bath simplicity and effectiveness in corrosion resistance of the cobalt conversion coating.

Bath Make-Up and Control

EXAMPLE 1

| Component (see note below) | Make-up Per Liter | Control per Liter |
|---|---|---|
| Cobalt nitrate (hexahydrate) $Co(NO_3)_2.6H_2O$ | 26 g | 24–29 g |
| Sodium nitrite $NaNO_2$ | 26 g | 24–29 g |
| Sodium chlorate $NaClO_3$ | 13 g | 12–16 g |
| Water (deionized) | balance | balance |
| Temperature | Room | 120–140° F. (preferred 120° F.) |

Note:
The above make-up represents chemical quantities which yield optimum processing results, however, coating formation is not limited to these parameters.

EXAMPLE 2

| Component (see note below) | Make-up per Liter | Control per Liter |
|---|---|---|
| Cobalt nitrate (hexahydrate) $Co(NO_3)_2.6H_2O$ | 26 g | 24–29 g |
| Sodium acetate $CH_3COONa$ | 26 g | 24–29 g |
| Or | | |
| Ammonium acetate $CH_3COONH_4$ | 35 g | 32–36 g |
| Sodium chlorate $NaClO_3$ | 13 g | 12–14 g |
| Water (deionized) | Balance | balance |
| Temperature | Room | 120–140° F. (Preferred 120° F.) |

Note:
The above make-up represents chemical quantities which yield optimum processing results, however, coating formation is not limited to these parameters.

EXAMPLE 3

| Component (see note below) | Make-up per Liter | Control per Liter |
|---|---|---|
| Cobalt nitrate (hexahydrate) $Co(NO_3)_2.6H_2O$ | 26 g | 24–29 g |
| Sodium formate $HCOONa$ | 26 g | 24–29 g |
| Or | | |
| Ammonium formate $HCOONH_4$ | 35 g | 32–36 g |
| Sodium chlorate $NaClO_3$ | 13 g | 12–14 g |
| Water (deionized) | Balance | Balance |
| Temperature | Room | 120–140° F. (Preferred 120° F.) |

Note:
The above make-up represents chemical quantities which yield optimum processing results, however, coating formation is not limited to these parameters.

Coatings are subsequently treated or sealed with a post treatment solution as described in U.S. Pat. No. 5,873,953, which is incorporated by reference herein, using the $V_2O_5/Na_2WO_4$ solution. When $NaClO_3$ is added to this post treatment, the solution becomes effective at room temperature.

EXAMPLE 4

Make-up and control of the post treatment or sealing treatment is as follows:

| Component | Make-up Per Liter | Control per Liter |
|---|---|---|
| Vanadium pentoxide $V_2O_5$ | 1.6 g | 1.5–2.0 g |
| Sodium tungstate $Na_2WO_4$ | 6.4 g | 6.0–6.5 g |
| Sodium chlorate $NaClO_3$ | 4.8 g | 4.5–5.0 g |
| Water (deionized) | Balance | balance |
| Temperature | Room | room |

Bath and Process Parameters

Cobalt Conversion Solution

The following bath make-up sequence was established and found important in achieving consistent, reproducible reaction products:

1. Fill tank (having an inert liner such as Neoprene or preferably a stainless steel tank) to ⅔ with deionized water. Begin air sparging to a gentle roll.
2. Add and dissolve the required chemicals in the following order:
   Cobalt nitrate
   Sodium nitrite
   Sodium chlorate
3. Fill the tank to the required level with water and let the solution react for a minimum of 8 hours.

4. Heat the tank to 120–140° F. (120° F. is preferred for longer bath life and bath stability) and maintain. The solution is now ready for operation.

Post Treatment Solution

The following bath make-up sequence for the post treatment has been established. It is also important to add the required chemicals in the sequence below:

1. Fill tank (having an inert liner such as Neoprene) to ¾ with deionized or distilled water. Begin air sparging to a gentle roll.
2. Now add and dissolve the required amounts of vanadium pentoxide and sodium tungstate. Vanadium pentoxide is slow to dissolve and that is why the tank is heated in order to aid the dissolution.
3. Add the required amount of sodium chlorate and heat the tank to 140° F.
4. Fill the tank to the required level with the balance of water. After all chemicals have been dissolved, let the solution cool to room temperature. The tank is now ready for operation.

Process Sequence

The following process sequence should be utilized in order to form conversion coatings meeting corrosion resistance and paint adhesion performance requirements:

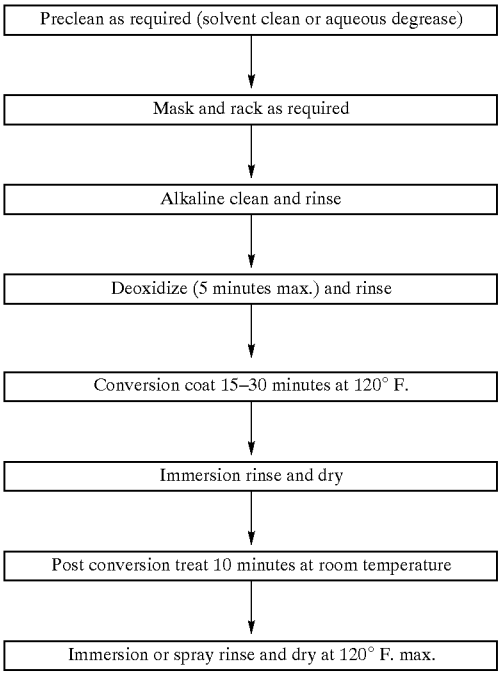

Effectiveness

The effectiveness of the $NaClO_3$ accelerator was evaluated with coating formulations other than Examples 1, 2, and 3, using positive ligand complexes, i.e., $$Co(NH_3)_6X_3$$

where X=Cl, $NO_3$, $SO_4$, or CN.

Negative ligand chemistry proved to be simpler and required less chemical control with respect to pH control, and also ammonia use and replenishment is not an issue. It was found that, in principle, any water soluble cobalt salt may be used for complexing in conjunction with sodium chlorate accelerator. Cobalt chloride, acetate, sulfate, formate, and nitrate are all usable with varying degrees of efficiency and $NaClO_3$ accelerator quantities vary when used with these formulations. For positive ligands, where the ammonium ion is used for cobalt complexing, it is still important to use the associated ammonium salt in conjunction with the cobalt salt, ammonium hydroxide (ammonia) complexer, and the accelerator. As described in U.S. Pat. No. 5,487,949, which is incorporated by reference herein, this is important in order to prevent precipitation of the freshly formed cobalt complex, by suppressing the hydroxyl ion concentration.

Regarding the use of sodium chlorate, other accelerator compounds belonging in the same chemical grouping were identified. These are $NaClO_2$, $NaClO_4$, $NaBrO_3$, and $NaIO_3$.

$NaClO_2$ was found to be too aggressive, resulting in pitting of the aluminum substrate during coating formation. $NaClO_4$ was not used because of extreme reactivity and danger of explosion. $NaBrO_3$ and $NaIO_3$ were found to be usable, however with decreased efficiency. The potassium salts of these compounds were not used, since potassium compounds have a tendency to drop cobalt out of solution.

OTHER METHODS OF APPLICATION

The above formulations illustrate producing cobalt conversion coatings by immersion application. The same principles apply to producing the conversion coating by manual application and by spray application.

The patents, specifications, and other publications referenced above are incorporated herein by reference.

Unless indicated otherwise, in stating a numerical range for a compound or a temperature or a time or other process matter or property, such a range is intended to specifically designate and disclose the minimum and the maximum for the range and each number, including each fraction and/or decimal, between the stated minimum and maximum for the range. For example, a range of 1 to 10 discloses 1.0, 1.1, 1.2 . . . 2.0, 2.1, 2.2, . . . and so on, up to 10.0. Similarly, a range of 500 to 1000 discloses 500, 501, 502, . . . and so on, up to 1000, including every number and fraction or decimal therewithin. "Up to x" means "x" and every number less than "x", for example, "up to 5" discloses 0.1, 0.2, 0.3, . . . , and so on up to 5.0.

As will be apparent to those skilled in the art to which the invention is addressed, the present invention may be embodied in forms other than those specifically disclosed above, without departing from the spirit or essential characteristics of the invention. The particular embodiments of the invention described above and the particular details of the processes described are therefore to be considered in all respects as illustrative and not restrictive. The scope of the present invention is as set forth in the appended claims rather than being limited to the examples set forth in the foregoing description. Any and all equivalents are intended to be embraced by the claims.

What is claimed is:

1. An improved process that is commercially practical for forming an oxide film cobalt conversion coating exhibiting corrosion resistance and paint adhesion properties on a substrate, where said substrate is aluminum or aluminum alloy, said process comprising the steps of:

(a) providing an oxide film forming cobalt conversion solution comprising an aqueous reaction solution, containing no triethanolamine (TEA), prepared by reacting the following starting materials:

(1) a water soluble cobalt-II salt $CoX_2$ where X=Cl, Br, $NO_3$, CN, SCN, $\frac{1}{3}PO_4$, $\frac{1}{2}SO_4$, $\frac{1}{2}CO_3$, formate, or acetate;

(2) a water soluble complexing agent selected from the group consisting of $MeNO_2$, MeAc, MeFm, $NH_4Ac$, and $NH_4Fm$, where Me is Na, K, or Li; Ac is acetate; and Fm is formate;

(3) an accelerator selected from the group consisting of $NaClO_3$, $NaBrO_3$, and $NaIO_3$; and (4) water; and (b) contacting said substrate with said aqueous reaction solution for a sufficient amount of time to oxidize the surface of said substrate, whereby said oxide film cobalt conversion coating is formed, thereby imparting corrosion resistance and paint adhesion properties to said substrate.

2. The process of claim 1 where said water-soluble cobalt-II salt is cobalt nitrate.

3. The process of claim 1 where said accelerator is $NaClO_3$.

4. The process of claim 1 comprising the additional step of contacting said coated substrate with an aqueous post conversion treatment solution comprising a solution of vanadium pentoxide and sodium tungstate.

5. A chemical conversion coating solution that is commercially practical for producing an oxide film cobalt conversion coating on an aluminum or aluminum alloy substrate, said solution consisting essentially of an aqueous reaction solution, containing no triethanolamine (TEA), prepared by reacting the following starting materials:

(1) a water soluble cobalt-II salt $CoX_2$ where X=Cl, Br, $NO_3$, CN, SCN, $\frac{1}{3}PO_4$, $\frac{1}{2}SO_4$, $\frac{1}{2}CO_3$, formate, or acetate, wherein the concentration of said cobalt-II salt is 24–29 grams per liter of solution;

(2) a water soluble complexing agent selected from the group consisting of $MeNO_2$ MeAc, MeFm, $NH_4$, and $NH_4Fm$ where Me is Na, K, or Li; Ac is acetate; and Fm is formate;

(3) an accelerator selected from the group consisting of $NaClO_3$, $NaBrO_3$, and $NaIO_3$; and (4) water.

6. The chemical conversion coating solution of claim 5 where said water-soluble cobalt-II salt is cobalt nitrate.

7. The chemical conversion coating solution of claim 5 where said accelerator is $NaClO_3$.

8. An improved process that is commercially practical for forming an oxide film cobalt conversion coating exhibiting corrosion resistance and paint adhesion properties on a substrate, where said substrate is aluminum or aluminum alloy, said process comprising the steps of:

(a) providing an oxide film forming cobalt conversion solution comprising an aqueous reaction solution, containing no triethanolamine (TEA), prepared by reacting the following starting materials:

(1) a water soluble cobalt-II salt $CoX_2$ where X=Cl, Br, $NO_3$, CN, SCN, $\frac{1}{3}PO_4$, $\frac{1}{2}S_4$, $\frac{1}{2}CO_3$, formate, or acetate;

(2) an ammonium salt $NH_4X$ where X=Cl, Br, $NO_3$, CN, SCN, $\frac{1}{3}PO_4$, $\frac{1}{2}SO_4$, $\frac{1}{2}CO_3$, formate, or acetate;

(3) ammonium hydroxide;

(4) an accelerator selected from the group consisting of $NaClO_3$, $NaBrO_3$, and $NaIO_3$;

(5) water; and (b) contacting said substrate with said aqueous reaction solution for a sufficient amount of time to oxidize the surface of said substrate, whereby said oxide film cobalt conversion coating is formed, thereby imparting corrosion resistance and paint adhesion properties to said substrate.

9. The process of claim 8 where said water-soluble cobalt-II salt is cobalt nitrate.

10. The process of claim 8 where said accelerator is $NaClO_3$.

11. A chemical conversion coating solution that is commercially practical for producing an oxide film cobalt conversion coating on an aluminum or aluminum alloy substrate, said solution consisting essentially of an aqueous reaction solution, containing no triethanolamine (TEA), prepared by reacting the following starting materials:

(1) a water soluble cobalt-II salt $CoX_2$ where X=Cl, Br, $NO_3$, CN, SCN, $\frac{1}{3}PO_4$, $\frac{1}{2}SO_4$, $\frac{1}{2}CO_3$, formate, or acetate;

(2) an ammonium salt $NH_4X$ where $CoX_2$ where X=Cl, Br, $NO_3$, CN, SCN, $\frac{1}{3}PO_4$, $\frac{1}{2}SO_4$, $\frac{1}{2}CO_3$, formate, or acetate;

(3) ammonium hydroxide;

(4) an accelerator selected from the group consisting of $NaClO_3$, $NaBrO_3$, and $NaIO_3$; and (5) water.

12. The chemical conversion coating solution of claim 11 where said water-soluble cobalt-II salt is cobalt nitrate.

13. The chemical conversion coating solution of claim 11 where said accelerator is $NaClO_3$.

* * * * *